US011044975B2

(12) United States Patent
Bungert

(10) Patent No.: US 11,044,975 B2
(45) Date of Patent: Jun. 29, 2021

(54) ORGANIZABLE LUNCHBOX SYSTEM AND METHOD

(71) Applicant: Ronald Bungert, Gillette, WY (US)

(72) Inventor: Ronald Bungert, Gillette, WY (US)

( * ) Notice: Subject to any disclaimer, the term of this patent is extended or adjusted under 35 U.S.C. 154(b) by 29 days.

(21) Appl. No.: 16/013,916

(22) Filed: Jun. 20, 2018

(65) Prior Publication Data

US 2018/0360178 A1 Dec. 20, 2018

Related U.S. Application Data

(60) Provisional application No. 62/522,195, filed on Jun. 20, 2017.

(51) Int. Cl.

| | |
|---|---|
| ***A45C 11/20*** | (2006.01) |
| ***A45C 13/02*** | (2006.01) |
| ***B65D 25/04*** | (2006.01) |
| ***F25D 3/08*** | (2006.01) |
| ***A45C 5/02*** | (2006.01) |
| ***A45F 3/04*** | (2006.01) |

(52) U.S. Cl.

CPC ..... *A45C 11/20* (2013.01); *A45C 5/02* (2013.01); *A45C 13/02* (2013.01); *A45F 3/04* (2013.01); *B65D 25/04* (2013.01); *F25D 3/08* (2013.01); *A45C 2013/026* (2013.01); *A45C 2200/20* (2013.01); *A45F 2200/0583* (2013.01); *F25D 2331/804* (2013.01)

(58) Field of Classification Search

CPC ..... B65D 81/3858; B65D 5/48038; B65D 25/04; B65D 81/3813; A45C 11/20; A45C 13/02; A45C 5/14; A45C 2200/20; A45C 2013/04; F25D 3/08; F25D 2331/804; A45F 2200/0583

USPC ..... 220/4.27, 528, 529; 206/541; 62/457.7

See application file for complete search history.

(56) References Cited

U.S. PATENT DOCUMENTS

| | | | | |
|---|---|---|---|---|
| 5,699,925 | A * | 12/1997 | Petruzzi | B65D 21/0204 206/508 |
| 5,718,336 | A | 2/1998 | Haarlander | |
| 6,357,252 | B1 * | 3/2002 | Rand | A45C 11/20 62/457.2 |
| 6,966,450 | B2 * | 11/2005 | Askew | B65D 25/06 220/529 |
| 8,863,546 | B2 * | 10/2014 | Oberweis | F25D 3/14 62/384 |
| 9,038,840 | B2 * | 5/2015 | Umholtz | A45C 13/008 220/4.27 |

(Continued)

*Primary Examiner* — Chun Hoi Cheung

(57) ABSTRACT

An organizable lunchbox system is disclosed herein. The organizable lunchbox system includes an organizable lunchbox comprising three stacked compartments and, a carrying case for the organizable lunchbox. The three stacked compartments of the organizable lunchbox include an upper compartment, a middle compartment and a lower compartment. The middle compartment is in thermal communication with the upper and lower compartments. In a preferred embodiment, the middle compartment is configured to retain an ice-pack to keep the contents of upper and lower compartments at a low temperature. The organizable lunchbox system further features a plurality of compartment dividers configured to partition the upper compartment and the lower compartment. Finally, the organizable lunchbox system includes an organizable lunchbox carrying case that is configured to retain the organizable lunchbox.

20 Claims, 5 Drawing Sheets

(56) References Cited

U.S. PATENT DOCUMENTS 9,284,095 B2 * 3/2016 Caruth ..... A61B 50/13
10,349,740 B2 * 7/2019 Olson ..... E05C 3/04
10,473,390 B2 * 11/2019 McCurry ..... F25D 31/005
2002/0134090 A1 * 9/2002 Rudick ..... F25D 23/12 62/6
2003/0150768 A1 * 8/2003 Dege ..... A47J 47/14 206/545
2004/0093892 A1 * 5/2004 Abfalter ..... F25D 3/08 62/457.7
2006/0288730 A1 * 12/2006 Shill ..... F25D 3/08 62/457.2
2008/0121630 A1 * 5/2008 Simard ..... A47J 41/0044 219/387
2010/0258576 A1 * 10/2010 Marquez ..... A45C 13/02 220/737
2010/0270317 A1 * 10/2010 Kieling ..... A45C 3/001 220/592.25
2010/0275642 A1 * 11/2010 Klettner ..... A45C 11/20 62/457.7
2012/0292327 A1 * 11/2012 Carey ..... A45C 13/02 220/592.2
2013/0043285 A1 * 2/2013 Cordray ..... A45C 13/02 224/148.3
2013/0119850 A1 * 5/2013 Breyburg ..... A47B 71/00 312/408
2013/0233741 A1 * 9/2013 Caruth ..... A45C 5/005 206/232
2014/0069915 A1 * 3/2014 Reyes ..... B65D 21/023 220/23.83
2014/0190865 A1 * 7/2014 Cecconi ..... A45C 13/02 206/542
2014/0367302 A1 * 12/2014 Umholtz ..... A45C 13/02 206/541
2016/0120162 A1 * 5/2016 Copper ..... A01K 97/05 43/56
2017/0008688 A1 * 1/2017 Barattin ..... A45C 7/0077
2018/0141739 A1 * 5/2018 Hengen ..... A45C 5/14
2019/0144164 A1 * 5/2019 Breyburg ..... B65D 43/22 220/495.01

* cited by examiner

ORGANIZABLE LUNCHBOX SYSTEM AND METHOD

CROSS-REFERENCE TO RELATED APPLICATION(S)

The present application is related to and claims priority to U.S. Provisional Patent Application No. 62/522,195 filed Jun. 20, 2017, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of containers of existing art and more specifically relates to portable meal containers.

RELATED ART

Lunchboxes are well known items used by children in school through adults at work. The standard lunchbox containers provide a single cavity capable of holding all food items together. The standard lunchbox containers comprise of a hard shell having a volume capable of storing food. However, the standard lunchbox container is only useful for storing some food items. Storable food items in a standard lunchbox include items that are not at a risk of compressing, absorbing moisture, or spoiling in a tepid environment. These limitations are considerable and effectively reduce the usability of the container to store desired food.

U.S. Pat. No. 5,718,336 to Michael Haarlander relates to a lunch box assembly. The described lunch box assembly includes a main housing having a lid portion and a base portion hingedly secured with one another so as to provide access to an opened interior of the improved lunch box assembly. Further, a display panel is included and secured in overlying relation to one exterior wall surface of the main housing so that it defines a pocket therebetween which is visually accessible through a display opening defined in the display panel. Also, a display insert is included and structured to be removably inserted into the pocket between the display panel and the exterior wall surface so that a primary display face thereof is visible through the display opening in the display panel and so that while it is securely maintained within the pocket when in use it can also be easily removed for convenient cleaning or interchanging with a new display insert.

SUMMARY OF THE INVENTION

In view of the foregoing disadvantages inherent in the known portable meal container art, the present disclosure provides a novel organizable lunchbox system and method. The general purpose of the present disclosure, which will be described subsequently in greater detail, is to provide a portable meal containers.

An organizable lunchbox system is disclosed herein. Briefly stated, the organizable lunchbox system includes an organizable lunchbox having an upper compartment, a middle compartment and a lower compartment. The organizable lunchbox system further features a plurality of compartment dividers configured to partition the upper compartment and the lower compartment. Finally, the organizable lunchbox system includes an organizable lunchbox carrying case that is configured to retain the organizable lunchbox.

More specifically, the upper compartment has an upper-interior, and an upper-exterior. The upper compartment has an upper-volume defined by upper-sidewalls, an upper-top surface and, an upper-base. The upper-top surface is hingedly connected to one of the upper-sidewalls to close the upper-volume. Each of the upper-sidewalls includes at least two upper-compartment guide slots. The middle compartment is disposed below and in thermal communication with the upper compartment. The middle compartment has a middle-volume defined by a middle-base, middle-sidewalls, and a middle-top surface. The middle-top surface is disposed adjacent to the upper-base. The middle compartment further includes a closable aperture disposed on one of the middle-sidewalls. The closable aperture allows access to the middle-volume. The lower compartment is disposed below, and in thermal communication with, the middle compartment. The lower compartment includes lower-sidewalls extending perpendicularly from a lower-base. One of the lower-sidewalls is hingedly connected to one of the middle-sidewalls. A lower-volume is defined by the lower-sidewalls, the lower-base and, the middle-base. Each of the lower-sidewalls includes at least two lower-compartment guide slots. The organizable lunchbox system includes a plurality of compartment dividers. Each of the plurality of compartment dividers includes opposing ends that are configured to mate with the upper-compartment guide slots and lower-compartment guide slots. The plurality of compartment dividers effectively partition the upper-volume, and, alternatively, the lower-volume.

The organizable lunchbox carrying case comprises a rigid base, a resealable storage compartment and, a plurality of pockets. The rigid base includes an interior surface and an exterior surface. The resealable storage compartment comprises a continuous wall having an interior and an exterior. The continuous wall circumscribes the rigid base and defines a front wall, a rear wall, and sidewalls. The resealable storage compartment defines a first cavity that is configured to store the organizable lunchbox. The first cavity is sealable by a first lid. A plurality of pockets are disposed on the exterior of the continuous wall.

According to another embodiment, a method of using an organizable lunchbox system is also disclosed herein. The method of using an organizable lunchbox system includes a step of, providing the organizable lunchbox system as described above. A step of, accessing the middle-volume of the middle compartment through the closable aperture. A step of, inserting an ice-back into the middle-volume. A step of, closing the closable aperture of the middle compartment, thereby sealing in the ice-pack. The method further comprises optional steps listed hereafter. A step of, partitioning the upper compartment with the plurality of compartment dividers. A step of, partitioning the lower compartment with the plurality of compartment dividers. A step of, removing the organizable lunchbox from the first cavity of the organizable lunchbox carrying case. A step of, inserting the organizable lunchbox into the first cavity of the organizable lunchbox carrying case.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, an organizable lunchbox system and method, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to portable meal containers and more particularly to an organizable lunchbox system and method as used to improve the existing lunchbox art.

Generally, the organizable lunchbox system provides a means to store and organize food items while providing a low temperature environment. The present lunchbox includes three stacked compartments, two of which are useful for storing food, with a middle compartment useful for storing an ice-pack. The upper compartment and the lower compartment include guide slots for removably replaceable walls that may be used to partition their respective interior volumes. The removably replaceable walls may be adjusted at a user's preference to accommodate various food items. The walls come in various sizes that may include guide slots of their own. The walls may be mated perpendicularly with each other to create smaller sections within the interior volumes of the food compartments. The middle compartment may be sandwiched between, and in thermal communication with, the upper compartment and the lower compartment. A user may insert an ice-pack, and alternatively, a heating-pack, into the middle compartment to regulate the temperature in the adjacent compartments.

The organizable lunchbox system further includes a durable carrying case configured to store the organizable lunchbox. The carrying case includes numerous pockets providing a means of retaining other items. A user may find the carrying case useful for storing electronic devices, notebooks, writing utensils, and other items that are commonly used. The carrying case may include shoulder straps, carabiners, buckles and various means of allowing a user to transport the carrying case. By design, the carrying case may be made of a durable material such as a reinforced canvas or similar material. A rigid base configured to withstand impact is also featured on the carrying case. The rigid base may be made of a rubber material having an impact disbursing design. Ultimately, the organizable lunchbox system provides an all-in-one utility for carrying food in an organized and temperature-controlled environment, as well as carrying commonly used items.

Referring now more specifically to the drawings by numerals of reference, there is shown in FIGS. 1-4, various views of an organizable lunchbox system 100.

Figure 1:
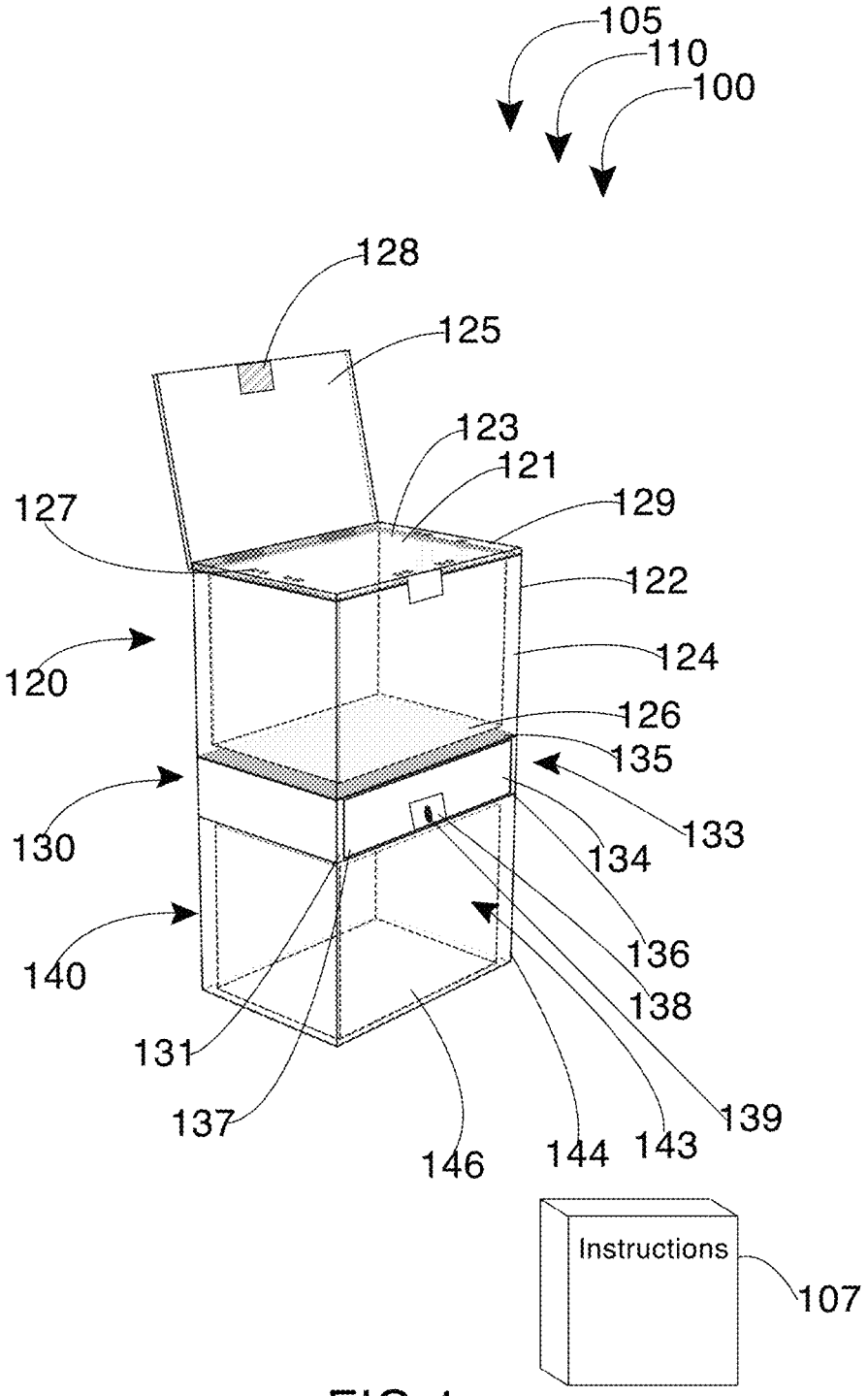
FIG. 1 is a perspective view of the organizable lunchbox system, according to an embodiment of the disclosure.
Figure 4:
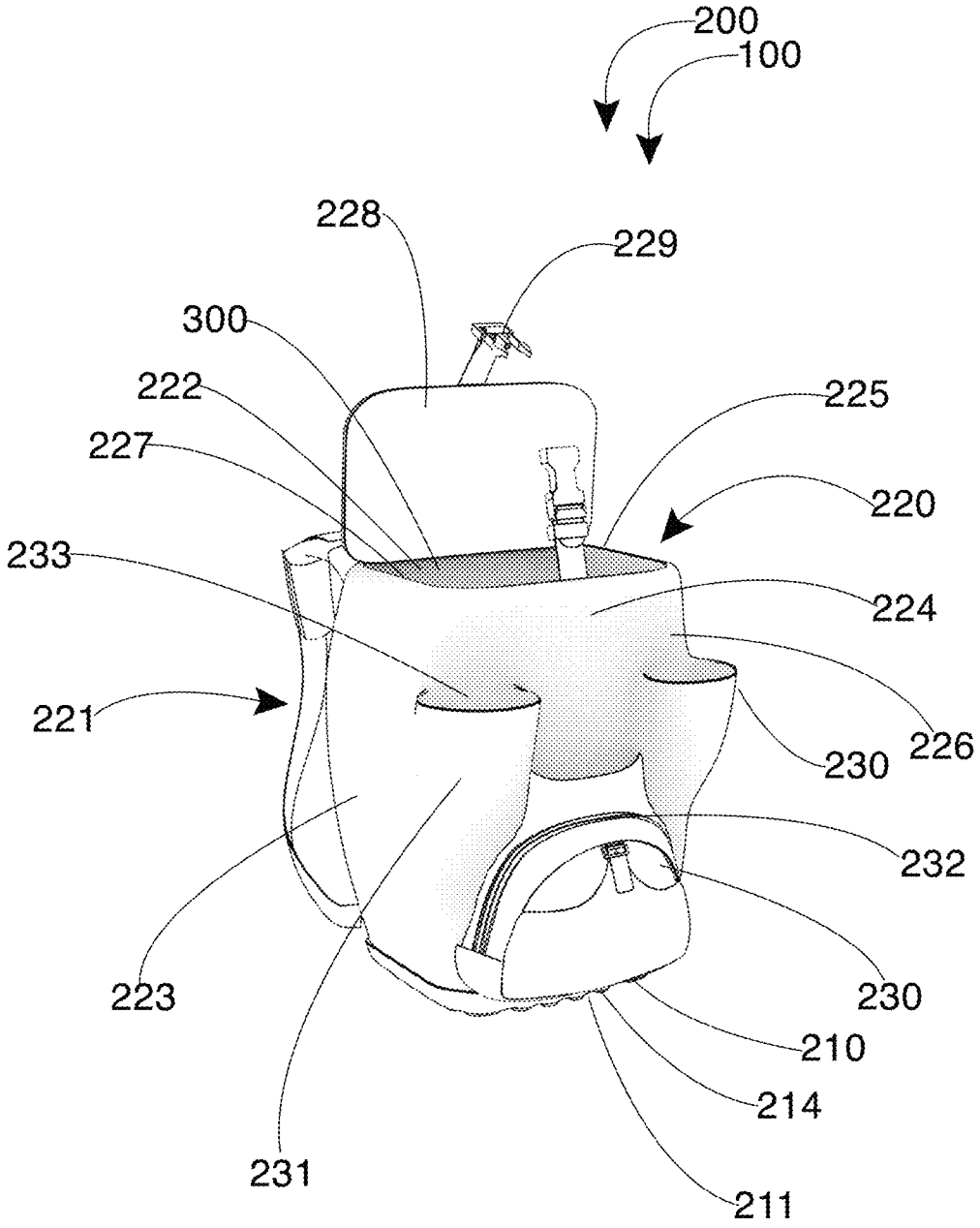
FIG. 4 is another view of the organizable lunchbox system of FIG. 1, according to an embodiment of the present disclosure.

FIG. 1 shows an organizable lunchbox system according to an embodiment of the present disclosure. Here, the organizable lunchbox system 100 may be beneficial to carry items. As illustrated, the organizable lunchbox system 100 may include an organizable lunchbox 110 comprising three stacked compartments and, an organizable lunchbox carrying case 200 (FIG. 4). The organizable lunchbox 110 comprises: an upper compartment 120, a middle compartment 130 and, a lower compartment 140. The upper compartment 120 has an upper-interior 121 and an upper-exterior 122. An upper-volume 123 is defined by upper-sidewalls 124, an upper-top surface 125 and, an upper-base 126. The upper-top surface 125 is hingedly connected to one of the upper-sidewalls 124 thereby closing the upper-volume 123. Each of the upper-sidewalls 124 includes at least two upper-compartment guide slots 127. The upper compartment 120 may further include an upper-locking mechanism 128 configured to retain the upper-top surface 125 in communication with the upper-sidewalls 124. The upper-locking mechanism 128 may create an upper-fluid proof seal 129 between the upper-top surface 125 and the upper-sidewalls 124.

The middle compartment 130 is disposed below, and in thermal communication with, the upper compartment 120. The middle compartment 130 has a middle-volume 133 defined by a middle-base 136, middle-sidewalls 134, and a middle-top surface 135. The middle-top surface 135 being disposed adjacent to the upper-base 126. The middle compartment 130 features a closable aperture 131 disposed on at least one of the middle-sidewalls 134. The closable aperture 131 allows access to the middle-volume 133. The closable aperture 131 of the middle compartment 130 may comprise a middle-door 137 pivotably attached to at least of the middle-sidewalls 134. In another embodiment, the middle-door 137 may be pivotably attached to the middle-top surface 135. The middle-door 137 may further include a middle-locking mechanism 138. The middle-locking mechanism 138 may be configured to close them middle-volume 133 create a middle-fluid proof seal 139.

Figure 2:
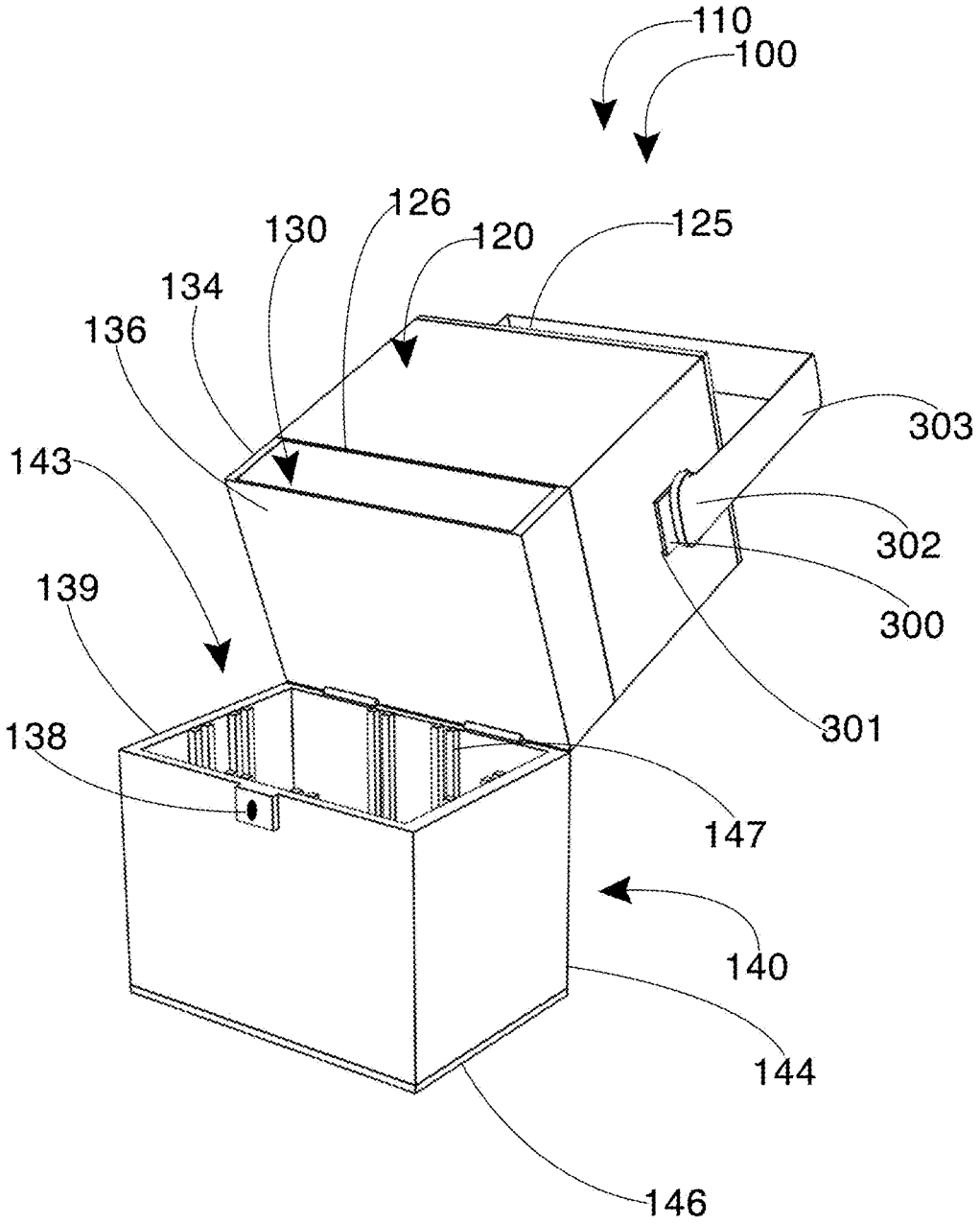
FIG. 2 is a perspective view of the organizable lunchbox system of FIG. 1, according to an embodiment of the present disclosure.

The lower compartment 140 is disposed below, and in thermal communication with, the middle compartment 130. The lower compartment 140 has a lower-volume 143 defined by a lower-base 146 having lower-sidewalls 144 extending perpendicularly therefrom. One of the lower-sidewalls 144 is hingedly connected to one of the middle-sidewalls 134. The lower-volume 143 is closed with the middle-base 136. Each of the lower-sidewalls 144 includes at least two lower-compartment guide slots 147 (FIG. 2).

A plurality of compartment dividers 150 (FIG. 3) are included with the organizable lunchbox system 100 to partition the upper compartment 120 and the lower compartment 140. Each of the plurality of compartment dividers 150 include opposing ends 151 (FIG. 3) configured to mate with the upper-compartment guide slots 127, and the lower-compartment guide slots 147 (FIG. 2).

The organizable lunchbox carrying case 200 is designed to carry the organizable lunchbox 110 and other auxiliary items. The organizable lunchbox carrying case 200 comprises a rigid base 210 (FIG. 4), a resealable storage compartment 220 (FIG. 4) and, a plurality of pockets 230 (FIG. 4).

According to one embodiment, the organizable lunchbox system 100 may be arranged as a kit 105. In particular, the organizable lunchbox system 100 may further include a set of instructions 107. The instructions 107 may detail functional relationships in relation to the structure of the organizable lunchbox system 100 such that the organizable lunchbox system 100 can be used, maintained, or the like, in a preferred manner.

FIG. 2 shows the organizable lunchbox system 100 of FIG. 1, according to an embodiment of the present disclosure. As above, the organizable lunchbox system 100 may include an organizable lunchbox 110 comprising an upper compartment 120, a middle compartment 130 and, a lower compartment 140. The middle compartment 130 includes a middle-base 136 connected to middle-sidewalls 134. The lower compartment 140 is disposed below, and in thermal communication with the middle compartment 130. The lower compartment 140 has a lower-volume 143 defined by a lower-base 146, lower-sidewalls 144 and the middle-base 136. As pictured, the one of the lower-sidewalls 144 is hingedly connected to one of the middle-sidewalls 134. The present configuration allows for the middle-base 136 to close the lower-volume 143 of the lower compartment 140. The lower compartment 140 may further feature a lower-locking mechanism 138 configured to retain the middle-base 136 in communication with the lower-sidewalls 144. The lower locking mechanism may create a lower-fluid proof seal 139 between the middle-base 136 and the lower-sidewalls 144. The lower-fluid proof seal 139 may disallow any foreign material to the organizable lunchbox 110 from entering the lower-volume 143. The lower compartment 140 further features at least two lower-compartment guide slots 147 disposed on each of the lower-sidewalls 144. The lower-compartment guide slots 147 may be used in conjunction with the plurality of compartment dividers 150 (FIG. 3) to partition the lower-volume 143.

In a preferred embodiment, the upper compartment 120 may include recessed tracks 300 disposed on the upper-exterior 122 (FIG. 1) of the upper-sidewalls 124 (FIG. 1). The recessed tracks 300 may include a track-bottom 301 and a track-top 302 that extend from the upper-base 126 to the upper-top surface 125 respectively. The recessed tracks 300 may be used to host a handle 303 that connects to the recessed tracks 300. The handle 303 may be configured to slide from the track-bottom 301 to the track-top 302, and vice versa, in the recessed tracks 300. The handle 303 may further have a full range of pivotability when the handle 303 is in a position at the track-top 302.

Figure 3:
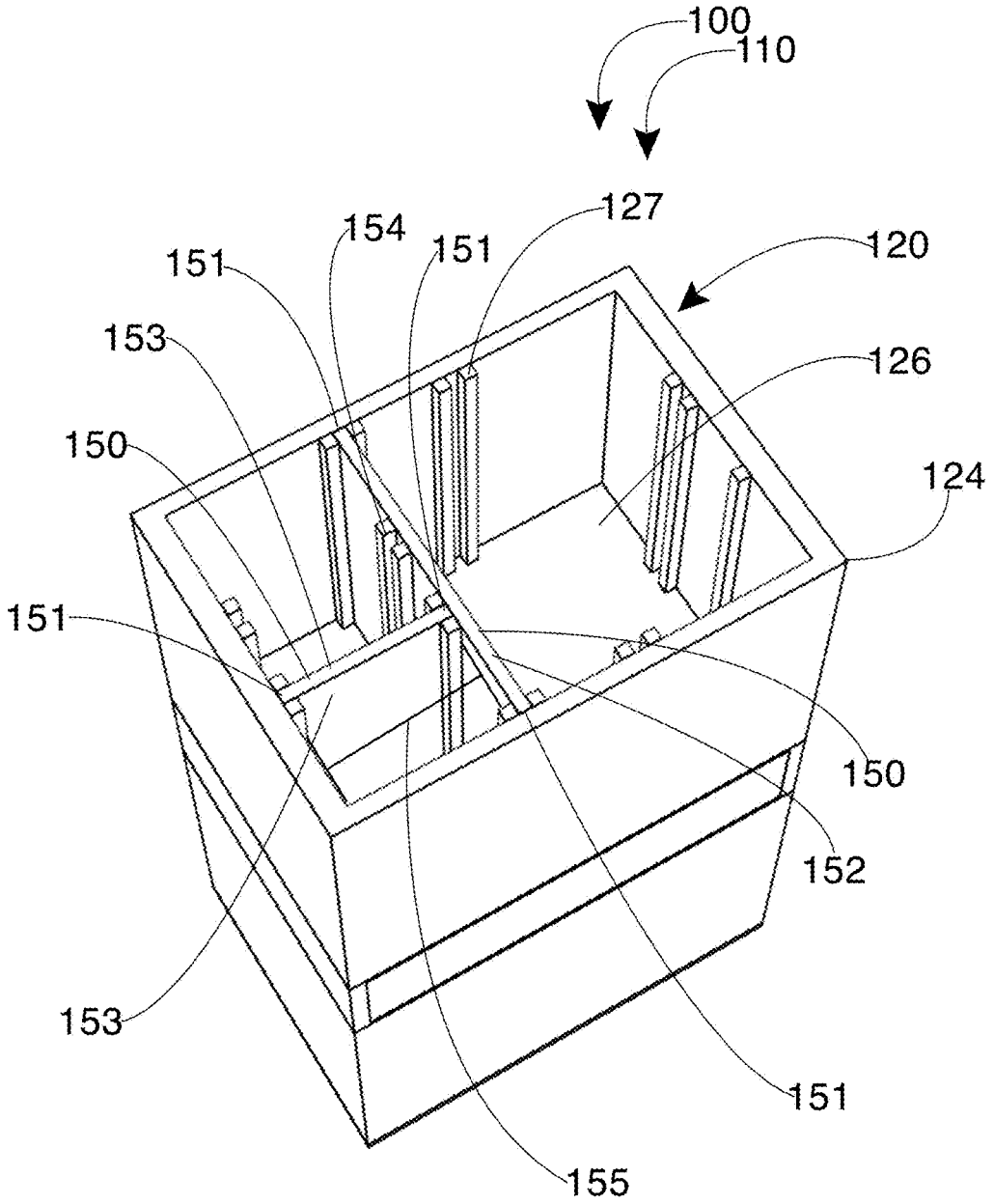
FIG. 3 is a top view of the organizable lunchbox system of FIG. 1, according to an embodiment of the present disclosure.

FIG. 3 is a top perspective view of the organizable lunchbox system 100 of FIG. 1, according to an embodiment of the present disclosure. As shown, the organizable lunchbox 110 includes an upper compartment 120 having an upper-base 126 and upper-sidewalls 124. Each of the upper-sidewalls 124 include at least two upper-compartment guide slots 127. The upper-compartment guide slots 127 are configured to mate with the opposing ends 151 of the plurality of compartment dividers 150. The plurality of compartment dividers 150 may be of disparate sizes. The plurality of compartment dividers 150 may include a first size of compartment dividers 152. The first size of compartment dividers 152 may be configured to extend between opposing upper-sidewalls 124, and alternatively, lower-sidewalls 144 (FIG. 2). The plurality of compartment dividers 150 may include a second size of compartment dividers 153. The second size of compartment dividers 153 may be configured to extend a partial distance 155 between opposing upper-sidewalls 124, and alternatively, opposing lower-sidewalls 144. Each of the plurality of compartment dividers 150 may include divider-guide slots 154. The divider-guide slots 154 may be configured to mate with the opposing ends 151 of the plurality of compartment dividers 150. The divider-guide slots 154 may allow the second size of compartment dividers 153 to perpendicularly mate with the first size of compartment dividers 152.

FIG. 4 is another view of the organizable lunchbox system 100 of FIG. 1, according to an embodiment of the present disclosure. As shown, the organizable lunchbox system 100 includes an organizable lunchbox carrying case 200. The organizable lunchbox carrying case 200 comprises a rigid base 210, a resealable storage compartment 220 and, a plurality of pockets 230. The rigid base 210 includes an interior surface (not shown) and an exterior surface 214. The exterior surface 214 of the rigid base 210 of the organizable lunchbox carrying case 200 may comprise a textured rubber 211 configured to absorb impact. The textured rubber 211 may inhibit vibrations from propagating through the organizable lunchbox system 100 if the organizable lunchbox carrying case 200 is dropped.

The resealable storage compartment 220 comprises a continuous wall 221 having an interior 222 and an exterior 223. The continuous wall 221 circumscribes the rigid base 210 and defines a front wall 224, a rear wall 225 and, sidewalls 226. The resealable storage compartment 220 defines a first cavity 227 configured to store the organizable lunchbox 110 (FIG. 1). The interior 222 of the continuous wall 221 of may include an insulative layer 300 of material. The insulative layer 300 of material may be configured to provide a thermal barrier between the first cavity 227 and the exterior 223 of the continuous wall 221. The first cavity 227 is sealable by a first lid 228. The first lid 228 may include a cavity-locking mechanism 229 configured to retain the first lid 228 over the first cavity 227.

The plurality of pockets 230 are disposed on the exterior 223 of the continuous wall 221. The plurality of pockets 230 may further include fasteners 232. The fasteners 232 may be configured to close the plurality of pockets 230. The fasteners 232 may include, buckles, snaps, zippers and, all further conceived means of fastening the plurality of pockets 230. The plurality of pockets 230 may include a beverage holder 231. The beverage holder 231 may comprise a closed tube having an upwardly oriented substantially circular opening 233.

Figure 5:
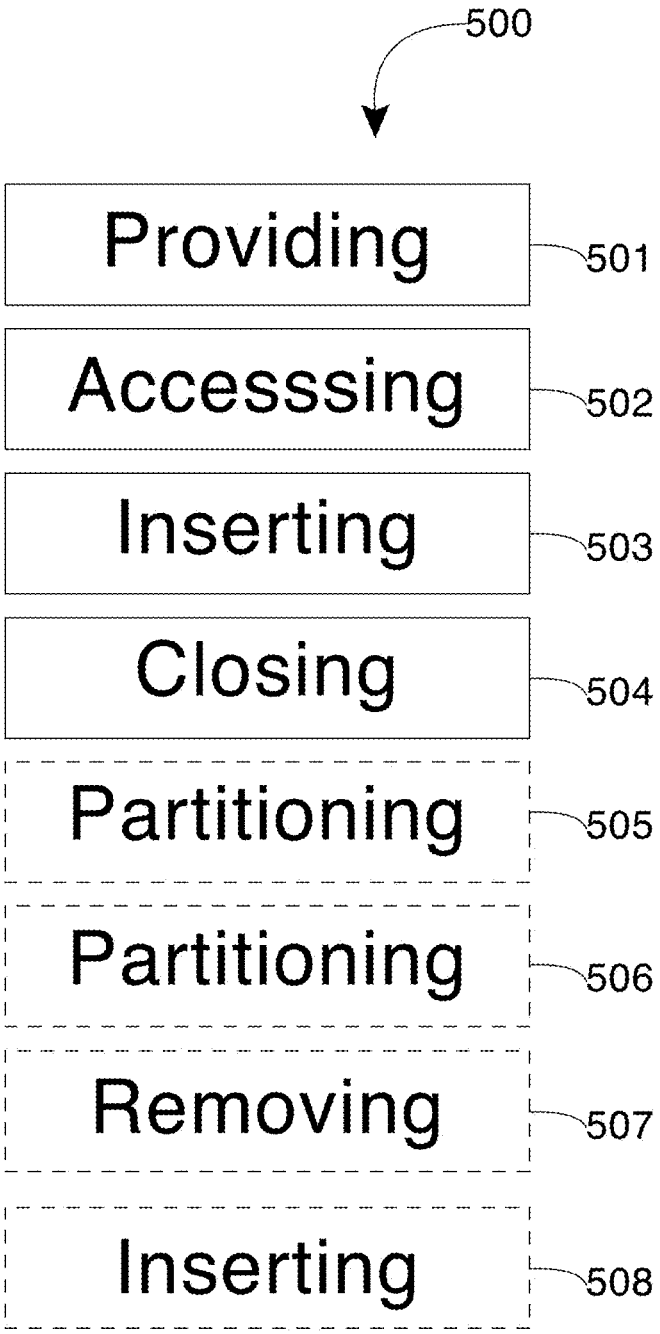
FIG. 5 is a flow diagram illustrating a method of using an organizable lunchbox system, according to an embodiment of the present disclosure.

FIG. 5 is a flow diagram illustrating a method for using an organizable lunchbox system, according to an embodiment of the present disclosure. In particular, the method for using an organizable lunchbox system 500 may include one or more components or features of the organizable lunchbox system 100 as described above. As illustrated, the method for using an organizable lunchbox system 500 may include the steps of: step one 501, providing an organizable lunchbox system, said organizable lunchbox system comprising: an organizable lunchbox, said organizable lunchbox comprising: an upper compartment, said upper compartment having an upper-interior, an upper-exterior and, an upper-volume defined by upper-sidewalls, an upper-top surface, and an upper-base, wherein said upper-top surface is hingedly connected to one of said upper-sidewalls thereby closing said upper-volume, wherein each of said upper-sidewalls including at least two upper-compartment guide slots; a middle compartment, said middle compartment disposed below and in thermal communication with said upper compartment, said middle compartment having a middle-volume defined by a middle-base, middle-sidewalls, and a middle-top surface disposed adjacent said upper-base, wherein at least one of said middle-sidewalls includes a closable aperture allowing access to said middle-volume; a lower compartment, said lower compartment disposed below, and in thermal communication with said middle compartment, said lower compartment having a lower-volume defined by a lower-base having lower-sidewalls extending perpendicularly therefrom, wherein one of said lower-sidewalls is hingedly connected to one of said middle-sidewalls thereby closing said lower-volume with said middle-base, wherein each of said lower-sidewalls including at least two lower-compartment guide slots; a plurality of compartment dividers, each of said plurality of compartment dividers having opposing ends configured to mate with said upper- and lower-guide slots to partition said upper-volume, and alternatively, said lower-volume; an organizable lunchbox carrying case, the case comprising: a rigid base, said rigid base having an interior surface and an exterior surface; a resealable storage compartment comprising a continuous wall having an interior and an exterior, said continuous wall circumscribing said rigid base and defining a front wall, a rear wall, and sidewalls, said resealable storage compartment defining a first cavity configured to store said organizable lunchbox, said first cavity sealable by a first lid; and, a plurality of pockets, said plurality of pockets disposed on said exterior of said continuous wall; step two 502, accessing said middle-volume of said middle compartment through said closable aperture; step three 503, inserting an ice-pack into said middle-volume; step four 504, closing said closable aperture of said middle compartment, thereby sealing in said ice-pack; step five 505, partitioning said upper compartment with said plurality of compartment dividers; step six 506, partitioning said lower compartment with said plurality of compartment dividers; step seven 507, removing said organizable lunchbox from said first cavity of said organizable lunchbox carrying case; step eight 508, inserting said organizable lunchbox into said first cavity of said organizable lunchbox carrying case;

It should be noted that steps 505, 506, 507 and, 508 are optional steps and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for using an organizable lunchbox system are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An organizable lunchbox system including an organizable lunchbox comprising three stacked compartments and, a carrying case for said organizable lunchbox, the system comprising:

an organizable lunchbox, said organizable lunchbox comprising:

an upper compartment, said upper compartment having an upper-interior, an upper-exterior and, an upper-volume defined by upper-sidewalls, an upper-top surface, and an upper-base, wherein said upper-top surface is hingedly connected to one of said upper-sidewalls thereby closing said upper-volume, wherein each of said upper-sidewalls including at least two upper-compartment guide slots;

a middle compartment, said middle compartment disposed below and in thermal communication with said upper compartment, said middle compartment having a middle-volume defined by a middle-base, middle-sidewalls, and a middle-top surface disposed adjacent said upper-base, wherein at least one of said middle-sidewalls includes a closable aperture allowing access to said middle-volume;

a lower compartment, said lower compartment disposed below, and in thermal communication with said middle compartment, said lower compartment having a lower-volume defined by a lower-base having lower-sidewalls extending perpendicularly therefrom, wherein one of said lower-sidewalls is hingedly connected to one of said middle-sidewalls thereby closing said lower-volume with said middle-base, wherein each of said lower-sidewalls including at least two lower-compartment guide slots;

a plurality of compartment dividers, each of said plurality of compartment dividers having opposing ends configured to mate with said upper- and lower-compartment guide slots to partition said upper-volume, and alternatively, said lower-volume;

an organizable lunchbox carrying case, the case comprising:

a rigid base, said rigid base having an interior surface and an exterior surface;

a resealable storage compartment comprising a continuous wall having an interior and an exterior, said continuous wall circumscribing said rigid base and defining a front wall, a rear wall, and sidewalls, said resealable storage compartment defining a first cavity configured to store said organizable lunchbox, said first cavity sealable by a first lid; and, a plurality of pockets, said plurality of pockets disposed on said exterior of said continuous wall.

2. The system of claim 1, wherein the upper compartment includes recessed tracks disposed on the upper-exterior of said upper-sidewalls, said recessed tracks having a track-bottom and a track-top extending from said upper-base to said upper-top surface respectively.

3. The system of claim 2, wherein the organizable lunchbox further comprises a handle connected to said recessed tracks, said handle configured to slide from track-bottom to track-top, and vice versa, in said recessed tracks.

4. The system of claim 1, wherein said upper compartment includes an upper-locking mechanism configured to retain said upper-top surface in communication with said upper-sidewalls, said upper-locking mechanism creating an upper-fluid proof seal between said upper-top surface and said upper-sidewalls.

5. The system of claim 1, wherein said closable aperture of said middle compartment comprises a middle-door pivotably attached to at least one of said middle-sidewalls.

6. The system of claim 5, wherein said middle-door is pivotably attached to said middle-top surface.

7. The system of claim 5, wherein said middle-door further comprising a middle-locking mechanism configured to close said middle-volume and create a middle-fluid proof seal.

8. The system of claim 1, wherein said lower compartment further comprises a lower-locking mechanism configured to retain said middle-base in communication with said lower-sidewalls, said lower-locking mechanism creating a lower-fluid proof seal between said middle-base and said lower-sidewalls.

9. The system of claim 1, wherein said plurality of compartment dividers include a first size of compartment dividers, said first size of compartment dividers configured to extend between opposing upper-sidewalls, and alternatively, opposing lower-sidewalls.

10. The system of claim 1, wherein said plurality of compartment dividers include a second size of compartment dividers, said second size of compartment dividers configured to extend a partial distance between opposing upper-sidewalls, and alternatively, opposing lower-sidewalls.

11. The system of claim 9, wherein said plurality of compartment dividers include divider-guide slots, said divider-guide slots configured to mate with said opposing ends of said plurality of compartment dividers.

12. The system of claim 1, wherein said exterior surface of said rigid base of said organizable lunchbox carrying case comprises a textured rubber configured to absorb impact.

13. The system of claim 1, wherein said interior of said continuous wall of said resealable storage compartment of said organizable lunchbox carrying case includes an insulative layer of material configured to provide a thermal barrier between said first cavity and said exterior of said continuous wall.

14. The system of claim 1, wherein said first lid of said resealable storage compartment includes a cavity-locking mechanism, said cavity-locking mechanism configured to retain said first lid over said first cavity.

15. The system of claim 1, wherein at least one of said plurality of pockets includes a beverage holder, said beverage holder comprising a closed tube having an upwardly oriented circular opening.

16. The system of claim 1, wherein said plurality of pockets further include fasteners configured to close said plurality of pockets.

17. An organizable lunchbox system, the system comprising:

an organizable lunchbox, said organizable lunchbox comprising:

an upper compartment, said upper compartment having an upper-interior, an upper-exterior and, an upper-volume defined by upper-sidewalls, an upper-top surface, and an upper-base, wherein said upper-top surface is hingedly connected to one of said upper-sidewalls thereby closing said upper-volume, wherein each of said upper-sidewalls including at least two upper-compartment guide slots, a middle compartment, said middle compartment disposed below and in thermal communication with said upper compartment, said middle compartment having a middle-volume defined by a middle-base, middle-sidewalls, and a middle-top surface disposed adjacent said upper-base, wherein at least one of said middle-sidewalls includes a closable aperture allowing access to said middle-volume, a lower compartment, said lower compartment disposed below, and in thermal communication with said middle compartment, said lower compartment having a lower-volume defined by a lower-base having lower-sidewalls extending perpendicularly therefrom, wherein one of said lower-sidewalls is hingedly connected to one of said middle-sidewalls thereby closing said lower-volume with said middle-base, wherein each of said lower-sidewalls including at least two lower-compartment guide slots, a plurality of compartment dividers, each of said plurality of compartment dividers having opposing ends configured to mate with said upper- and lower-compartment guide slots to partition said upper-volume, and alternatively, said lower-volume, an organizable lunchbox carrying case, the case comprising:

a rigid base, said rigid base having an interior surface and an exterior surface, a resealable storage compartment comprising a continuous wall having an interior and an exterior, said continuous wall circumscribing said rigid base and defining a front wall, a rear wall, and sidewalls, said resealable storage compartment defining a first cavity configured to store said organizable lunchbox, said first cavity sealable by a first lid, and, a plurality of pockets, said plurality of pockets disposed on said exterior of said continuous wall;

wherein the upper compartment includes recessed tracks disposed on the upper-exterior of said upper-sidewalls, said recessed tracks having a track-bottom and a track-top extending from said upper-base to said upper-top surface respectively;

wherein the organizable lunchbox further comprises a handle connected to said recessed tracks, said handle configured to slide from track-bottom to track-top, and vice versa, in said recessed tracks;

wherein said upper compartment includes an upper-locking mechanism configured to retain said upper-top surface in communication with said upper-sidewalls, said upper-locking mechanism creating an upper-fluid proof seal between said upper-top surface and said upper-sidewalls;

wherein said closable aperture of said middle compartment comprises a middle-door pivotably attached to at least one of said middle-sidewalls;

wherein said middle-door is pivotably attached to said middle-top surface;

wherein said middle-door further comprising a middle-locking mechanism configured to close said middle-volume and create a middle-fluid proof seal;

wherein said lower compartment further comprises a lower-locking mechanism configured to retain said middle-base in communication with said lower-sidewalls, said lower-locking mechanism creating a lower-fluid proof seal between said middle-base and said lower-sidewalls;

wherein said plurality of compartment dividers include a first size of compartment dividers, said first size of compartment dividers configured to extend between opposing upper-sidewalls, and alternatively, opposing lower-sidewalls;

wherein said plurality of compartment dividers include a second size of compartment dividers, said second size of compartment dividers configured to extend a partial distance between opposing upper-sidewalls, and alternatively, opposing lower-sidewalls;

wherein said plurality of compartment dividers include divider-guide slots, said divider-guide slots configured to mate with said opposing ends of said plurality of compartment dividers;

wherein said exterior surface of said rigid base of said organizable lunchbox carrying case comprises a textured rubber configured to absorb impact;

wherein said interior of said continuous wall of said resealable storage compartment of said organizable lunchbox carrying case includes an insulative layer of material configured to provide a thermal barrier between said first cavity and said exterior of said continuous wall;

wherein said first lid of said resealable storage compartment includes a cavity-locking mechanism, said cavity-locking mechanism configured to retain said first lid over said first cavity;

wherein at least one of said plurality of pockets includes a beverage holder, said beverage holder comprising a closed tube having an upwardly oriented circular opening;

wherein said plurality of pockets further include fasteners configured to close said plurality of pockets.

18. The system of claim 17, further comprising set of instructions; and wherein the system is arranged as a kit.

19. A method of using an organizable lunchbox system, the method comprising the steps of:

providing an organizable lunchbox system including an organizable lunchbox comprising three stacked compartments and, a carrying case for said organizable lunchbox, the system comprising:

an organizable lunchbox, said organizable lunchbox comprising:

an upper compartment, said upper compartment having an upper-interior, an upper-exterior and, an upper-volume defined by upper-sidewalls, an upper-top surface, and an upper-base, wherein said upper-top surface is hingedly connected to one of said upper-sidewalls thereby closing said upper-volume, wherein each of said upper-sidewalls including at least two upper-compartment guide slots;

a middle compartment, said middle compartment disposed below and in thermal communication with said upper compartment, said middle compartment having a middle-volume defined by a middle-base, middle-sidewalls, and a middle-top surface disposed adjacent said upper-base, wherein at least one of said middle-sidewalls includes a closable aperture allowing access to said middle-volume;

a lower compartment, said lower compartment disposed below, and in thermal communication with said middle compartment, said lower compartment having a lower-volume defined by a lower-base having lower-sidewalls extending perpendicularly therefrom, wherein one of said lower-sidewalls is hingedly connected to one of said middle-sidewalls thereby closing said lower-volume with said middle-base, wherein each of said lower-sidewalls including at least two lower-compartment guide slots;

a plurality of compartment dividers, each of said plurality of compartment dividers having opposing ends configured to mate with said upper- and lower-compartment guide slots to partition said upper-volume, and alternatively, said lower-volume;

an organizable lunchbox carrying case, the case comprising:

a rigid base, said rigid base having an interior surface and an exterior surface;

a resealable storage compartment comprising a continuous wall having an interior and an exterior, said continuous wall circumscribing said rigid base and defining a front wall, a rear wall, and sidewalls, said resealable storage compartment defining a first cavity configured to store said organizable lunchbox, said first cavity sealable by a first lid; and, a plurality of pockets, said plurality of pockets disposed on said exterior of said continuous wall;

accessing said middle-volume of said middle compartment through said closable aperture;

inserting an ice-pack into said middle-volume;

closing said closable aperture of said middle compartment, thereby sealing in said ice-pack.

20. The method of claim 19, further comprising the steps of partitioning said upper compartment with said plurality of compartment dividers;

partitioning said lower compartment with said plurality of compartment dividers;

removing said organizable lunchbox from said first cavity of said organizable lunchbox carrying case;

inserting said organizable lunchbox into said first cavity of said organizable lunchbox carrying case.

* * * * *